US006978709B2

(12) United States Patent
Aalto et al.

(10) Patent No.: US 6,978,709 B2
(45) Date of Patent: Dec. 27, 2005

(54) BREECH DEVICE FOR BOLT ACTION FIREARMS

(75) Inventors: Juha Aalto, Riihimäki (FI); Kari Kuparinen, Loppi (FI)

(73) Assignee: Sako Oy, Riihimaki (FI)

( * ) Notice: Subject to any disclaimer, the term of this patent is extended or adjusted under 35 U.S.C. 154(b) by 0 days.

(21) Appl. No.: 10/469,859

(22) PCT Filed: Mar. 5, 2002

(86) PCT No.: PCT/FI02/00169

§ 371 (c)(1),
(2), (4) Date: Apr. 6, 2004

(87) PCT Pub. No.: WO02/075234

PCT Pub. Date: Sep. 26, 2002

(65) Prior Publication Data

US 2004/0168362 A1 Sep. 2, 2004

(30) Foreign Application Priority Data

Mar. 5, 2001 (FI) ..... 20010430

(51) Int. Cl.[7] ..... F41A 3/08

(52) U.S. Cl. ..... 89/188; 89/185; 89/33.1

(58) Field of Search ..... 89/172, 174, 185, 89/188, 33.1

(56) References Cited

U.S. PATENT DOCUMENTS

| | | | | | |
|---|---|---|---|---|---|
| 2,735,206 | A | * | 2/1956 | Butler et al. | 42/18 |
| 3,370,372 | A | * | 2/1968 | Thompson | 42/16 |
| 3,416,253 | A | | 12/1968 | Larsson et al. | |
| 4,481,858 | A | * | 11/1984 | Price | 89/11 |
| 4,920,677 | A | * | 5/1990 | Schuerman | 42/16 |
| 5,826,361 | A | * | 10/1998 | Jamison | 42/25 |
| 6,000,161 | A | * | 12/1999 | Aalto | 42/16 |

FOREIGN PATENT DOCUMENTS

| | | | | |
|---|---|---|---|---|
| GB | 1 221 018 | * | 2/1971 | 89/188 |
| SE | 466 119 B | | 12/1991 | |
| WO | 96/35917 A1 | | 11/1996 | |

* cited by examiner

*Primary Examiner*—Stephen M. Johnson
(74) *Attorney, Agent, or Firm*—Buchanan Ingersoll PC

(57) ABSTRACT

A breech device for bolt-action firearms includes a breech body reciprocating in the receiver and rotatable into locking position. In its front part, the breech body has locking lugs located in three sectors, the locking lugs in at least two sectors being formed in a breech device equipped with a magazine loaded in parallel so that there are four guide surfaces to limit rotation between the receiver and the breech body, and the breech body has a recessed locking surface for the cartridge at its end. The locking surface of the cartridge has been extended downwardly to form a glide surface passing between the locking lugs so that the rear surface of the cartridge case slides on the glide surface and the locking surface into locking position as the cartridge is ejected from the magazine into the cartridge housing.

4 Claims, 1 Drawing Sheet

BREECH DEVICE FOR BOLT ACTION FIREARMS

The invention relates to a breech device for bolt-action firearms, the breech device consisting of a breech body reciprocating in the receiver and rotatable into locking position, having in its front portion locking lugs located in three sectors, with the locking lugs in at least two sectors formed in a breech device equipped with a magazine loaded in parallel, so that there are four guide surfaces to limit rotation between the receiver and the breech body, and the breech body has a recessed cartridge locking surface at its end.

Thus, WO 96/35917, for instance, discloses a breech device of this type known per se. In practical operation, the cartridge has proved not to pass from the magazine to the cartridge housing without problems in all cases, especially when the cartridge contains a short bullet. This is due to the fact that the detached cartridge base is no longer under the control of the magazine under the loading movement until the bullet reaches the cartridge housing, so that the cartridge may easily turn in a way to make the bullet point hit the edge of the cartridge housing, thus causing a jam during aiming. The purpose of the invention is to eliminate this shortcoming. The breech device of the invention is characterised by the locking surface of the cartridge being extended downwardly to form a glide surface between the locking lugs so that the rear surface of the cartridge case slides on the glide surface and the locking surface into locking position as the cartridge is ejected from the magazine into the cartridge housing.

One embodiment of the invention is characterised by the defining walls of the locking lugs on the glide surface being at a mutual angle of 70 to 80°, forming a funnel to guide the rear surface of the case.

It has been experimentally proved that the breech device of the invention allows the cartridge to pass without problems from the magazine into the cartridge housing, because the locking surface and the glide surface are in the same plane and provide a regular propulsive force over the entire rear surface of the cartridge while the funnel-like walls of the locking lugs guide the cartridge in exact rectilinear displacement into the cartridge housing. Since cartridges with bullets of varying weights and lengths can be used in the same firearm, the breech device of the invention allow any bullets of different weights suitable for the firearm to operate without jams during loading.

Figure 1:
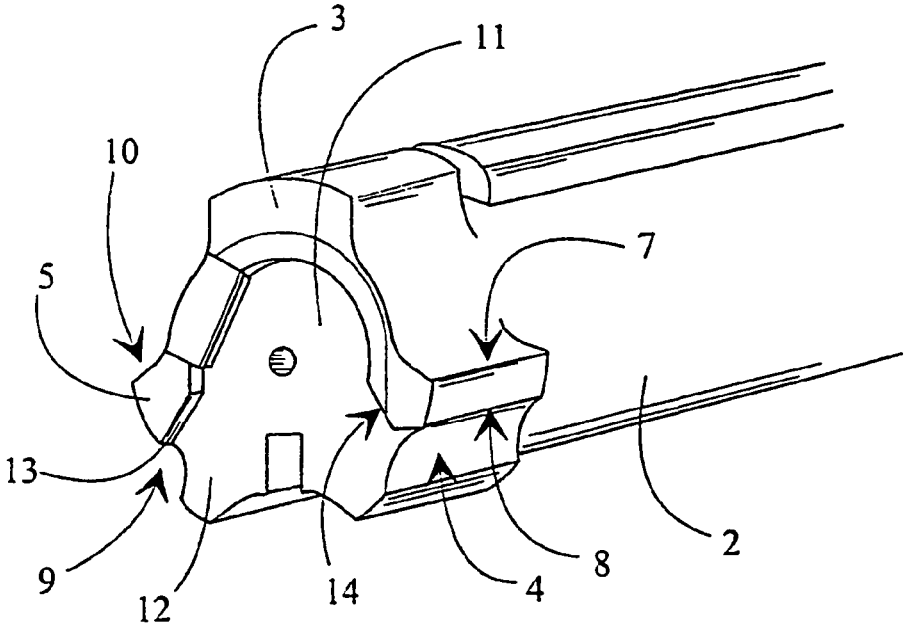
Figure 2:
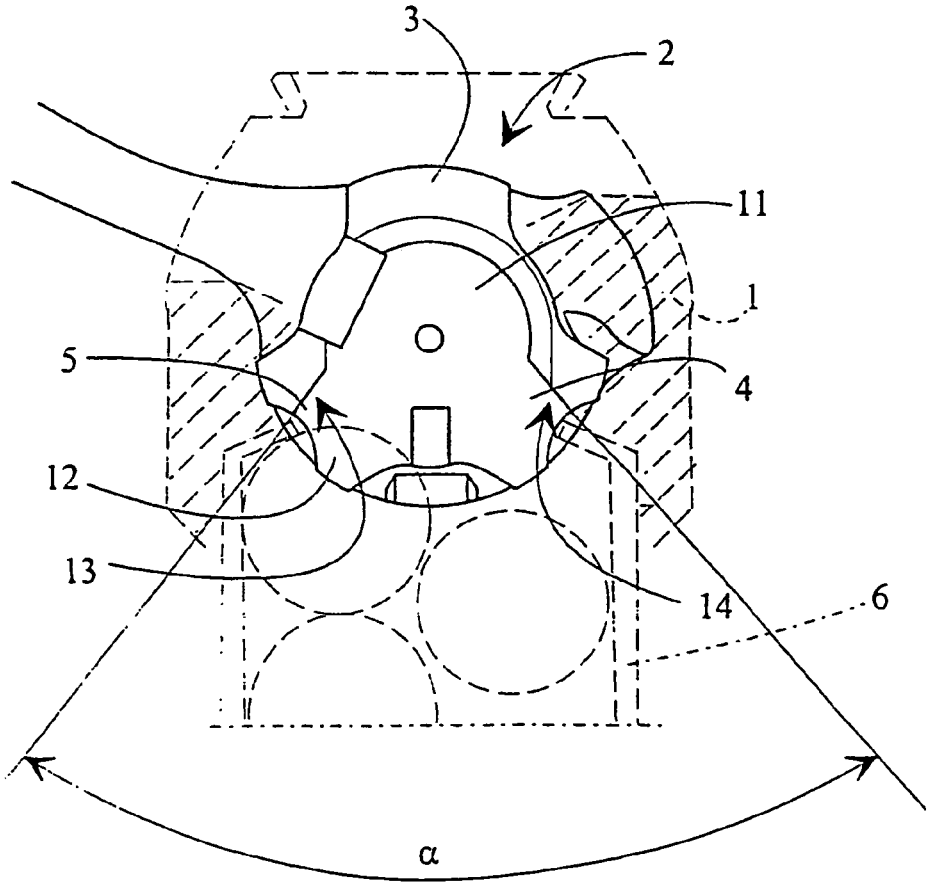

The invention is described by means of an example below and with reference to the accompanying drawing, in which FIG. 1 is an axonometric view of the front portion of the bolt action and FIG. 2 shows the bolt action viewed straight from the front.

One embodiment of the breech device consists of a breech body 2 reciprocating in the receiver 1 and rotatable into locking position. At its front part, the breech body has locking lugs 3, 4, 5 located in three sectors, the locking lugs 4, 5 in two sectors being formed in the breech device equipped with a magazine 6 loaded in parallel so that there are four guide surfaces 7, 8, 9, 10 to limit rotation between the receiver 1 and the breech body 2. The breech body 2 has a recessed locking surface 11 for the cartridge and its end.

The locking surface 11 of the cartridge has been extended downwardly to form a glide surface passing between the locking lugs 4, 5, so that the rear surface of the cartridge case slides on the glide surface and the locking surface into locking position when the cartridge is ejected from the magazine 6 into the cartridge housing in the barrel. The walls 13, 14 of the locking lugs on the glide surface 12 are at a mutual angle ($\alpha$) of about 70–80°, forming a funnel to guide the rear surface of the case. The glide surface portion extends into an outlet end 6*a* of the magazine, as shown in FIG. 2.

What is claimed is:

1. A breech device for bolt-action firearms, the breech device comprising a breech body and a magazine, the magazine is removable and comprises an outer casing that defines a containment area for containing multiple unconnected cartridges, the breech body reciprocating in a receiver and being rotatable into a position wherein the breech body is locked with respect to the receiver in a position for firing, the breech body having in its front portion at least three locking lugs located in three sectors, the locking lugs in at least two of the three sectors arranged adjacent an outlet end of the magazine and together having four guide surfaces for acting against the receiver to limit rotation between the receiver and the breech body, and the breech body has a recessed cartridge locking surface at an end of the breech body, wherein the cartridge locking surface includes a glide surface portion extending between the at least two locking lugs and into an outlet end of the magazine so that during use a rear surface of a cartridge ejected from the magazine slides on the glide surface and the locking surface into a position where the cartridge is locked with respect to the breech body, as the cartridge is ejected from the magazine.

2. A breach device as defined by claim 1, further comprising defining walls of the locking lugs on the glide surface that are at a mutual angle ($\alpha$) of about 70 to 80°, forming a funnel to guide the rear surface of the cartridge.

3. A breech device as defined by claim 1, wherein during use the breech body moves forward so that the glide surface contacts the rear surface of the cartridge and causes the cartridge to eject from the magazine.

4. A breech device for bolt-action firearms, the breech device comprising a breech body for reciprocating in a receiver and being rotatable into a locked position, the breech body having in its front portion at least three locking lugs located in three sectors, the locking lugs in at least two of the three sectors adapted to be adjacent a magazine loaded in parallel so that there are four guide surfaces to limit rotation between the receiver and the breech body, and the breech body has a recessed locking surface for a cartridge at an end of the breech body, wherein the cartridge locking surface includes a glide surface extending between the locking lugs so that during use a rear surface of a cartridge slides on the glide surface and the locking surface into a position where the cartridge is locked with respect to the breech body, as the cartridge is ejected from the magazine;

further comprising defining walls of the locking lugs on the glide surface that are at a mutual angle ($\alpha$) of about 70 to 80°, forming a funnel to guide the rear surface of the cartridge.

* * * * *